US010118742B2

(12) United States Patent
Paul

(10) Patent No.: US 10,118,742 B2
(45) Date of Patent: Nov. 6, 2018

(54) PACKAGE WITH PORTION CONTROL

(71) Applicant: Sonoco Development, Inc., Hartsville, SC (US)

(72) Inventor: Melia Paul, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 15/156,424

(22) Filed: May 17, 2016

(65) Prior Publication Data

US 2016/0340090 A1 Nov. 24, 2016

Related U.S. Application Data

(60) Provisional application No. 62/164,120, filed on May 20, 2015.

(51) Int. Cl.

| | |
|---|---|
| ***B65D 43/26*** | (2006.01) |
| ***B65D 41/16*** | (2006.01) |
| ***B65D 43/02*** | (2006.01) |
| ***B65D 1/16*** | (2006.01) |

(52) U.S. Cl.

CPC ..... *B65D 43/26* (2013.01); *B65D 1/16* (2013.01); *B65D 43/0212* (2013.01); *B65D 2543/00055* (2013.01); *B65D 2543/0062* (2013.01); *B65D 2543/0074* (2013.01); *B65D 2543/00092* (2013.01); *B65D 2543/00296* (2013.01); *B65D 2543/00351* (2013.01); *B65D 2543/00537* (2013.01); *B65D 2543/00694* (2013.01); *B65D 2543/00805* (2013.01); *B65D 2543/00944* (2013.01)

(58) Field of Classification Search

CPC ..... B65D 2543/00296; B65D 2543/00351; B65D 2543/00537; B65D 2543/0062; B65D 2543/00694; B65D 2543/0074; B65D 2543/00805; B65D 2543/00944; B65D 2543/00055; B65D 43/0212; B65D 11/16; B65D 42/26

USPC ..... 220/262, 281; 215/209, 225, 224

See application file for complete search history.

(56) References Cited

U.S. PATENT DOCUMENTS

| | | | | |
|---|---|---|---|---|
| 3,101,856 A * | 8/1963 | Whiteman, Jr. | ..... | B65D 50/046 215/209 |
| 3,830,393 A * | 8/1974 | Schaefer | ..... | B65D 50/045 215/209 |
| 4,473,162 A * | 9/1984 | Donoghue | ..... | B65D 50/046 215/209 |
| 5,394,999 A * | 3/1995 | Krall | ..... | B65D 50/046 215/209 |
| 5,411,160 A * | 5/1995 | Goulet | ..... | B65D 43/0212 215/209 |
| 7,828,166 B1 * | 11/2010 | Sprick | ..... | B65D 47/242 215/209 |

(Continued)

*Primary Examiner* — J. Gregory Pickett
*Assistant Examiner* — Niki M Eloshway
(74) *Attorney, Agent, or Firm* — Flaster/Greenberg P.C.

(57) ABSTRACT

A package is provided for storing and dispensing consumable goods. The package includes a container base having a defined interior volume for retaining a quantity of consumable goods and an open top end for dispensing the goods. A lid is formed to overlap with the top end of the base. The lid defines a portion volume that is less than the retaining volume of the base. Structures are provided for retaining the lid on and releasing the lid from the top end of the base.

10 Claims, 9 Drawing Sheets

(56) References Cited

U.S. PATENT DOCUMENTS

| | | | | |
|---|---|---|---|---|
| 8,479,935 | B2 * | 7/2013 | Straughan | B65D 50/046 215/216 |
| 8,915,388 | B2 * | 12/2014 | Rice | B65D 50/046 215/209 |
| 2004/0245204 | A1 * | 12/2004 | Suffa | B65D 41/0471 215/224 |
| 2005/0220939 | A1 | 10/2005 | Morrow | |
| 2009/0090712 | A1 | 4/2009 | Vovan | |
| 2011/0006027 | A1 * | 1/2011 | Domoy | A45D 40/0068 215/10 |
| 2011/0062043 | A1 | 3/2011 | Bougoulas et al. | |
| 2012/0312820 | A1 | 12/2012 | Cadiente | |
| 2014/0166659 | A1 | 6/2014 | Antal, Sr. et al. | |
| 2015/0366755 | A1 * | 12/2015 | Milante | A61J 1/1425 215/203 |

* cited by examiner

PACKAGE WITH PORTION CONTROL

CROSS REFERENCE TO RELATED APPLICATION

The present application claims priority to and the benefit of the filing date of U.S. Provisional Application Ser. No. 62/164,120, filed May 20, 2015.

FIELD OF THE INVENTION

The present invention relates to a package for storing and dispensing consumable goods, with the package including a portion measuring lid.

BACKGROUND OF THE INVENTION

Market research indicates that packaging for consumable goods, such as nuts, candies, and other "bite size" snacks, may be a driver for the repeated purchase of the goods. Further, there is a desire for a way to measure the serving portion or size to control or limit calorie intake. In addition, consumers desire packaging to allow the user to snack on the go.

Many packages today are in the form of either a flexible pack or a generic cup-like container with a flat stock lid. These existing packages do not fully meet the consumer's desires for packaging and often create drawbacks to the ease of consumption.

SUMMARY OF THE INVENTION

In one aspect of the present disclosure, a package is defined for storing and dispensing consumable goods. The package comprises a container base and a portion measuring lid that may be removably fixed to the base.

In another aspect of the present disclosure, a package is provided for storing and dispensing consumable goods. The package includes a container base having a defined interior volume for retaining a quantity of consumable goods and an open top end for dispensing the goods. A lid is formed to overlap with the top end of the base. The lid defines a portion volume that is less than the retaining volume of the base. Engagement structures are provided for retaining the lid on and releasing the lid from the top end of the base.

The container base may be blow molded, injection molded or otherwise formed, with engagement structures integrally formed thereon for engaging with and retaining a lid. The lid includes a fixed interior volume for defining a desirable portion of the contents stored in the base. The lid may also be blow molded, injection molded, or otherwise formed, with a matching set of integrally formed engagement structures.

In another aspect of the contemplated structure, one or two release buttons are provided on the base. The release buttons are depressed by the user, preferably in a single handed manner, to initiate flexing of the sidewalls of the base and the separation of the lid from its engagement with the top end of the base.

In a further aspect of the package, the lid defines an interior volume that corresponds to a desired portion size for the consumable goods retained by the container base. As such, the lid may be used to control portion to be consumed. The base and lid components of the package are preferably sized to fit in a typical automobile or similar cup holder.

BRIEF DESCRIPTION OF THE DRAWINGS

For the purpose of illustrating the invention, there is shown in the drawings a number of forms which are presently preferred; it being understood that the invention is not limited to the precise arrangements and instrumentalities shown.

DETAILED DESCRIPTION

Figure 1:
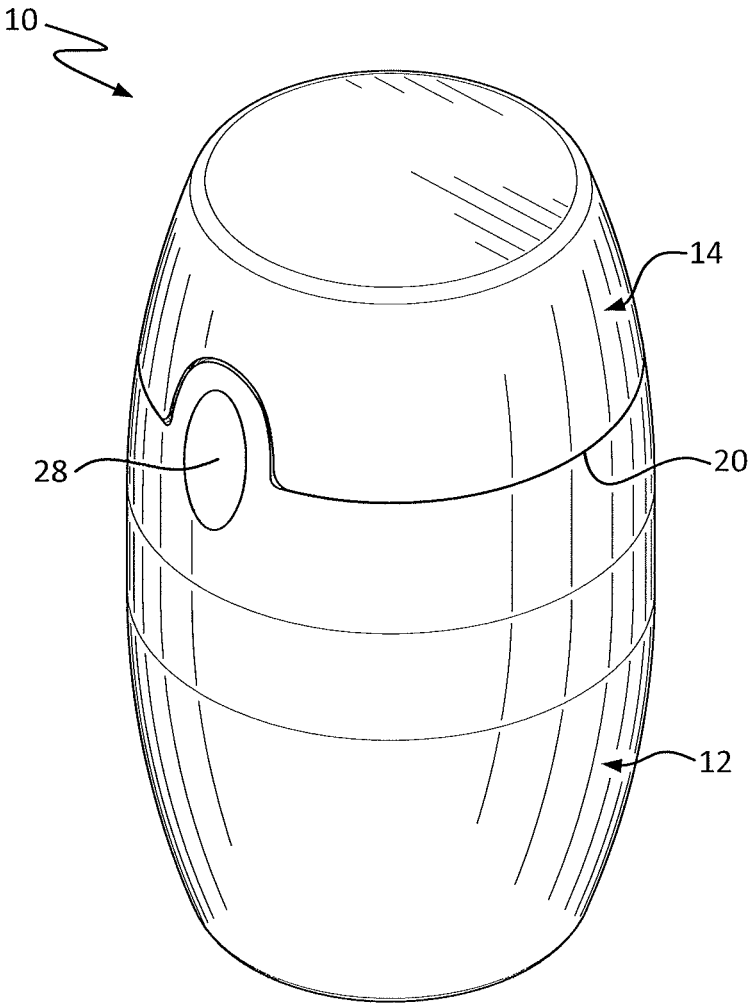
FIG. 1 is an isometric view of an embodiment of a package as contemplated by the present disclosure.
Figure 2:
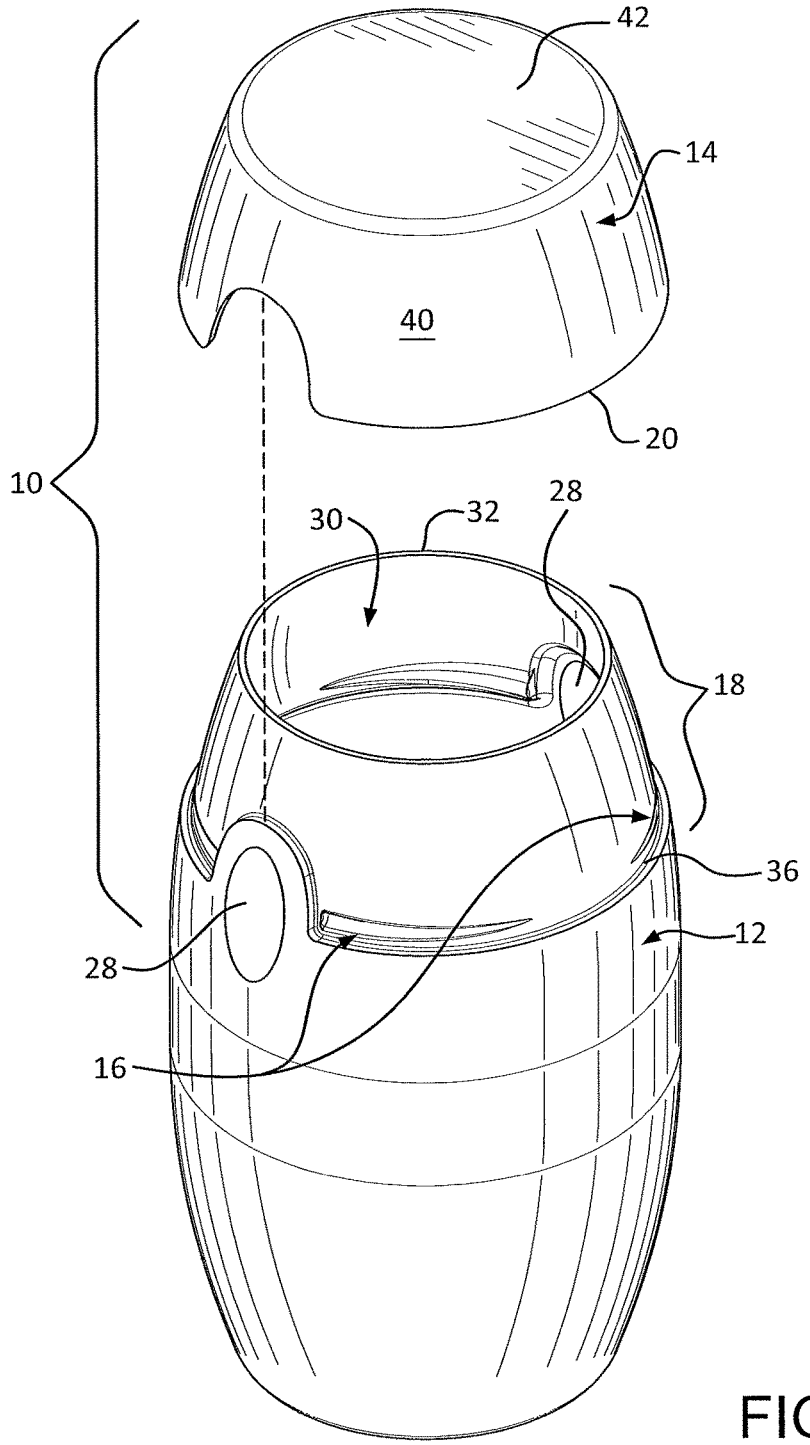
FIG. 2 is an isometric view of the package of FIG. 1 with the base and lid shown in an exploded position.
Figure 3:
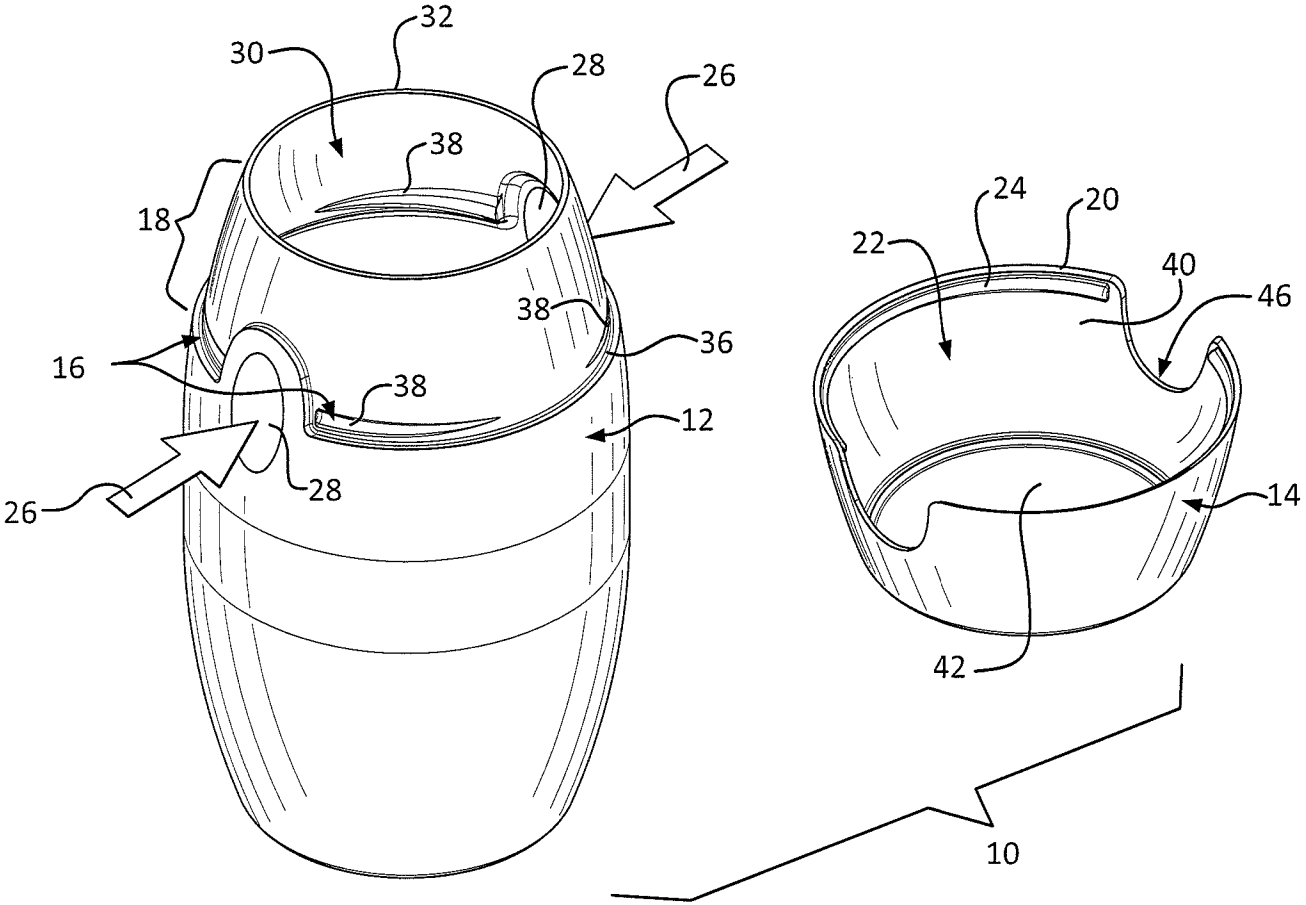
FIG. 3 is an isometric view of the package of FIG. 1 with the base and lid shown in an exploded position and the lid inverted to form a portion cup.

Referring now to the drawings, where like numerals identify like elements, there is shown in FIG. 1 a package which is generally referred to by the numeral 10. In FIG. 1, the package 10 is comprised of a container or base 12 and a lid or cap 14. The lid 14 is shown positioned on and fixed to an upper portion of the base 12. In FIG. 2, the lid 14 is exploded away from the base 12, exposing retaining structures 16 on the upper or top end 18 of the base 12. A rim 20 on the lid 14 is contoured to fit onto and mater with the tope end 18 of the base 12. In FIG. 3, the lid 14 is inverted, exposing a portion volume 22 defined within the interior of the lid 14. Lid engagement structures 24 are formed within the interior of the lid 14, adjacent to the rim 20. Arrows 26 are shown in FIG. 3 representing an opening or release force that is applied to a pair of activation buttons 28 on opposite sides of top end 18 of the base 12. The release operation is described in further detail below. The interior of the base 12 forms a retaining volume 30 for storage of a consumable product or goods (not shown). Access to the retaining volume 30 is provided through an opening defined in the top end 18 of the base 12. The access opening is surrounded by a base rim 32.

Figure 4:
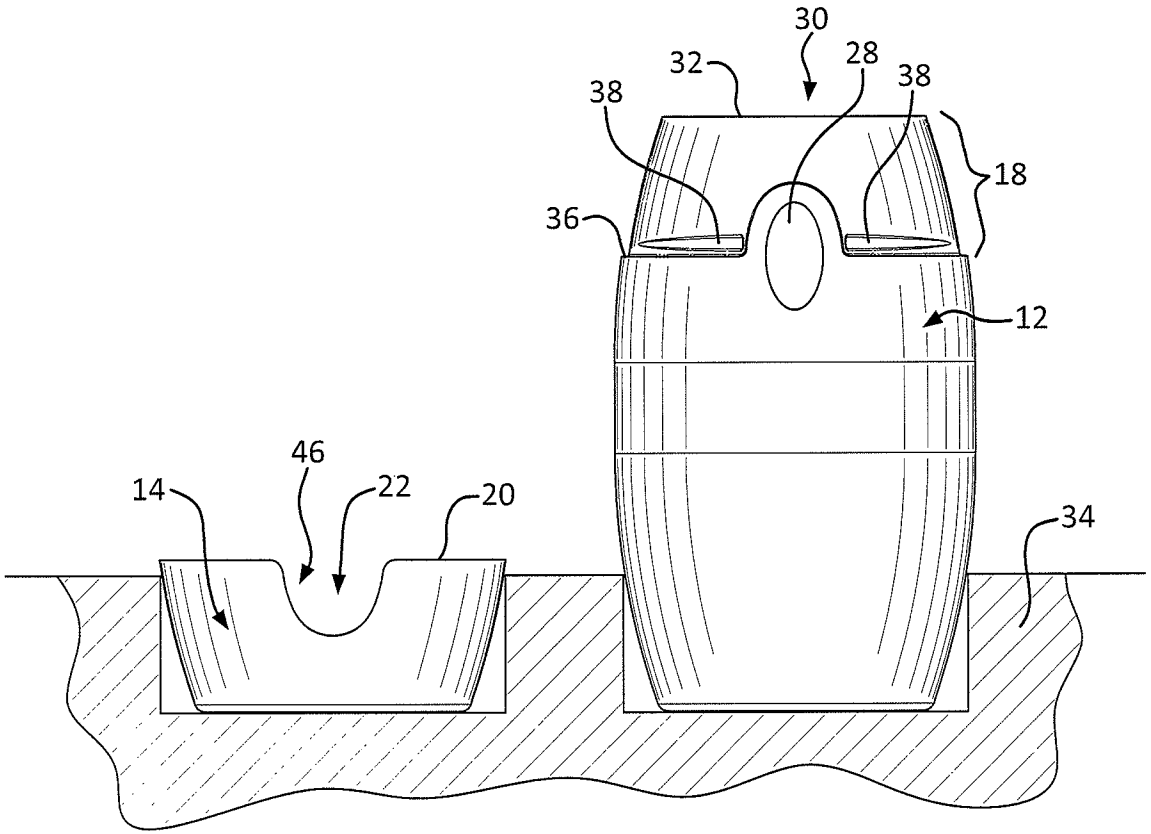
FIG. 4 is a side elevation of the exploded package of FIG. 3 with the base and lid supported in an automobile or similar cup holder.

In FIG. 4, the package 10 is shown in an exploded condition, with both the base 12 and lid 14 supported in a generally illustrated cup holder 34. The holder 34 of the type generally shown is typically provided at various positions within automobiles, on furniture, or as part of other devices and is generally use for supporting a drink cup and other objects. A typical cup holder has an internal diameter of about 2.5 inches to 3 inches. Various spring loaded structures (not shown) may be provided to resiliently secure a cup or other object and to deter release of the cup, etc based on movement, vibration or the like. In FIG. 4, it is shown that the preferred outside dimensions of the base 12 and the lid 14 are set to be snuggly received within the cub holder 34. The base 12 is separated from the lid 14, with the portion volume 22 of the lid 12 exposed to receive contents from the retaining volume 30 of the base 14. The contents in the lid 12 may be accessed by the user, such as a driver, passenger or the like (not show).

Figure 6:
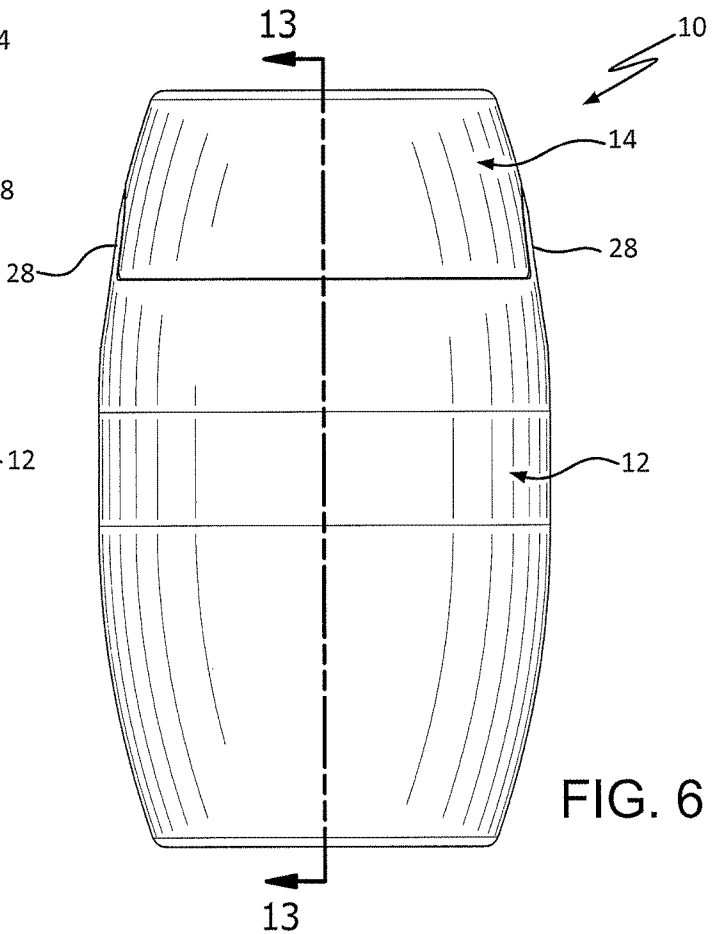
FIG. 6 is a second side elevation of the package embodiment of FIG. 1; the elevation view being 90 degrees from the view in FIG. 5.
Figure 5:
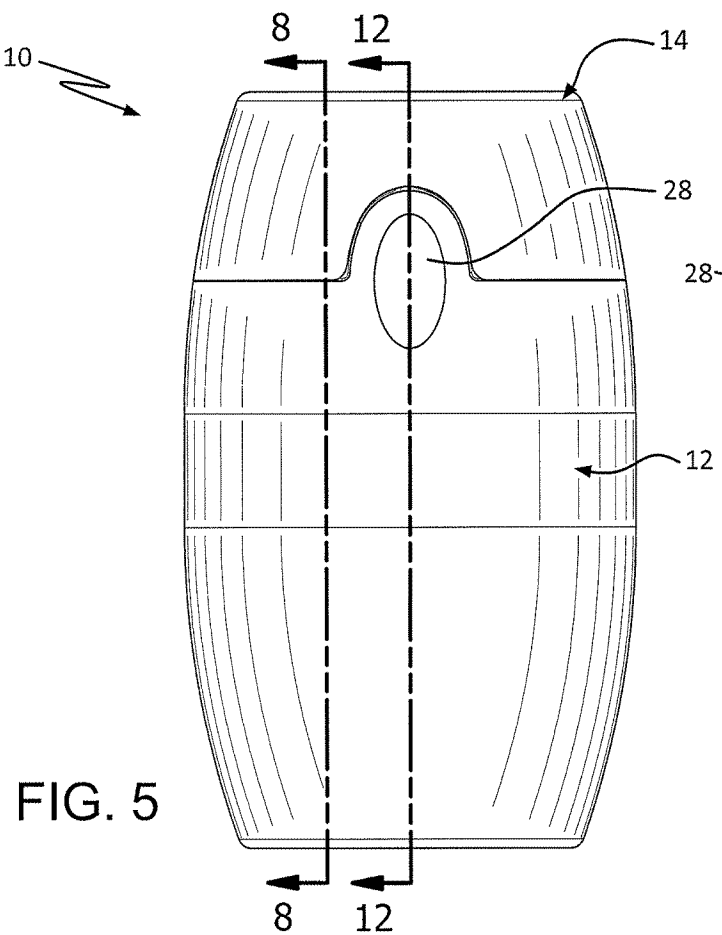
FIG. 5 is a first side elevation of the package embodiment of FIG. 1 with a lid release button being shown.
Figure 7:
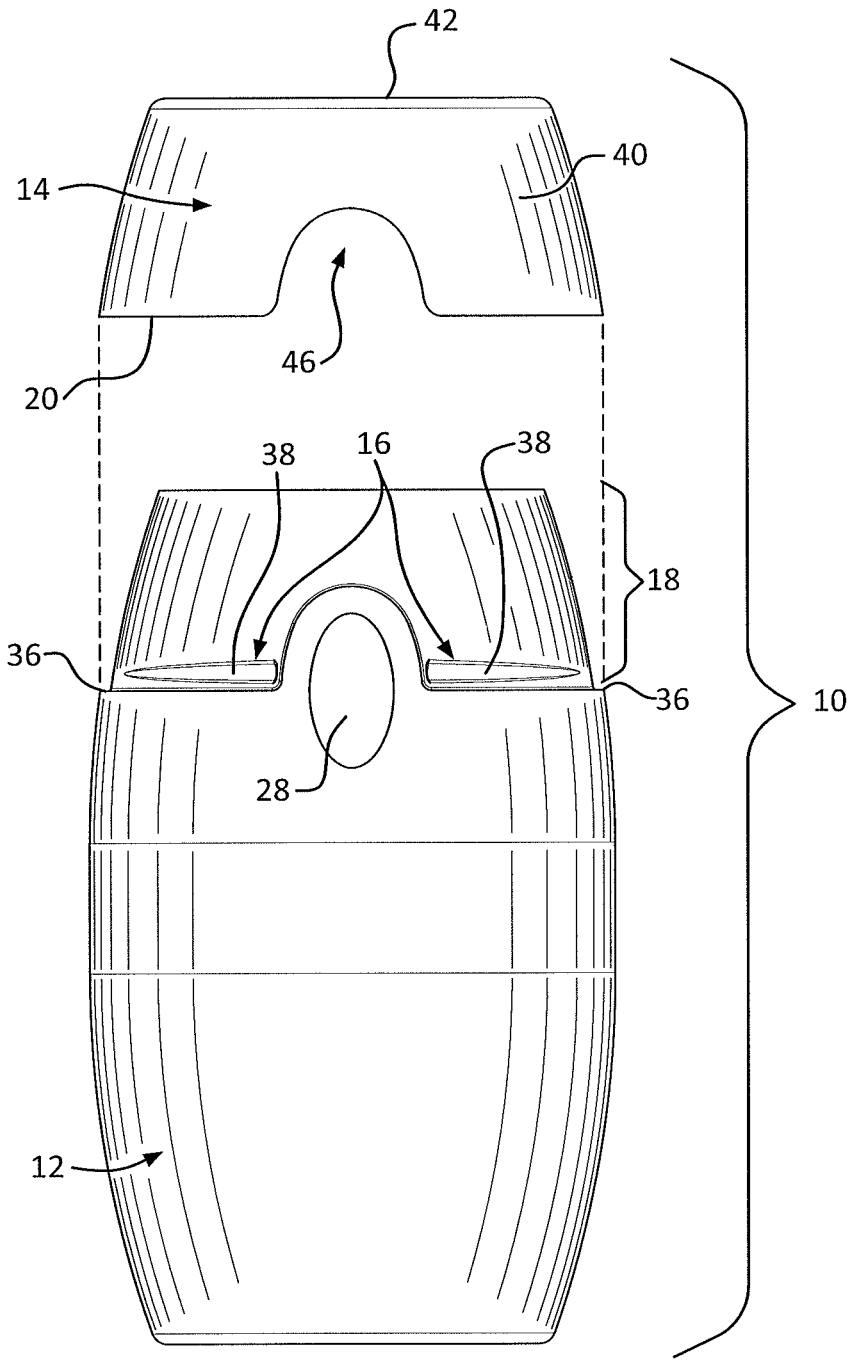
FIG. 7 is a further side elevation view of the package similar to that in FIG. 5 with base and lid being shown in an exploded position.
Figure 9:
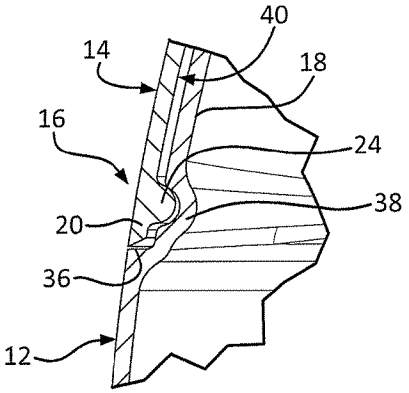
FIG. 9 is an enlarged detail view of part of the package, as taken from the cross section in FIG. 8.

In FIGS. 5 and 6, the package 10 is shown in side elevation. In FIG. 5, one activation button 28 is visible, with a second similarly formed button provided on the opposite side of the container base 12. In FIG. 6, the package 10 is rotated 90 degrees about a central vertical axis from the view in FIG. 5 and two buttons 28 are shown in profile on opposite sides of the base 12. In both figures, the lid 14 is retained on the top end of the base 12. In FIG. 7, the lid 14 is released from the top end 18 of the base 12, exposing the contours of the rim 20 of the lid 12. A shoulder or lip 36 is provided in the sidewall of the base 12. The shoulder 36 is formed to receive the rim 20 of the lid 12 to create a smooth or integrated outside surface for the package 10, when assembled (such as that shown in FIGS. 5 and 6).

In FIGS. 8-11, the assembled package 10 is shown in cross section with various features of the engagement structures 16 illustrated. As shown in FIG. 7, for example, there are two retainer grooves 38 positioned on opposite sides of the activation button 28. In FIG. 3, for example, the inside surface of the sidewall 40 of the lid 14 includes a retainer bar 24 extending between the cutouts or contour slots 42 on the rim 20 that receive the buttons 28 on the base 12. The engagement structures 16 are detailed in FIG. 9 and include the retainer bars 24 on the lid 12 and the receiving grooves 38 on the top end 18 of the base 12. The grooves 38 receive a portion of the bar 24 and form a friction fit for retaining the lid 14 on the top end 18 of the base 12. The rim 20 of the lid 14 is preferably secured against the shoulder 36 within the sidewall of the base 12. The top end 18 of the base 12 extends upwardly from the shoulder 36. There is an overlap created of the sidewall 40 of the lid 14 and the top end 18 of the container 12. This overlap by the extension of the top end 18 of the base 12 serves to maximize the retaining volume 30. The height of the sidewall 40 of the lid 14 serves to fix the lid volume 22 and set the maximum serving portion for product or goods.

Figure 10:
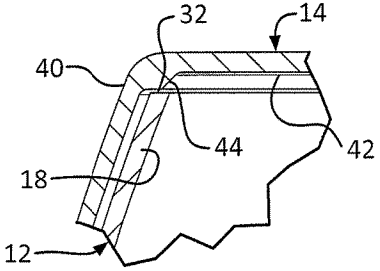
FIG. 10 is an enlarged detail view of a separate part of the package, as taken from the cross section in FIG. 8.
Figure 8:
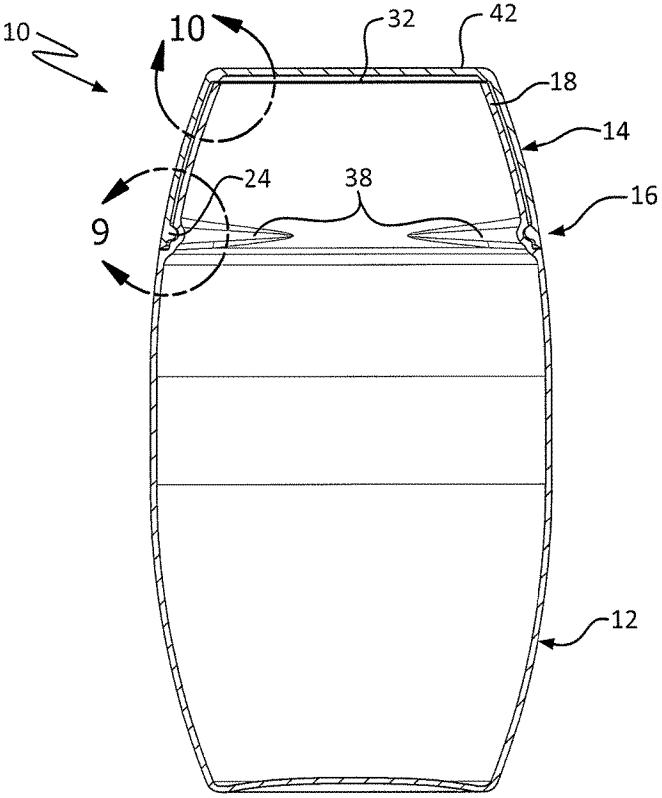
FIG. 8 is a cross section view of the package as taken along line 8-8 in FIG. 5.
Figure 11:
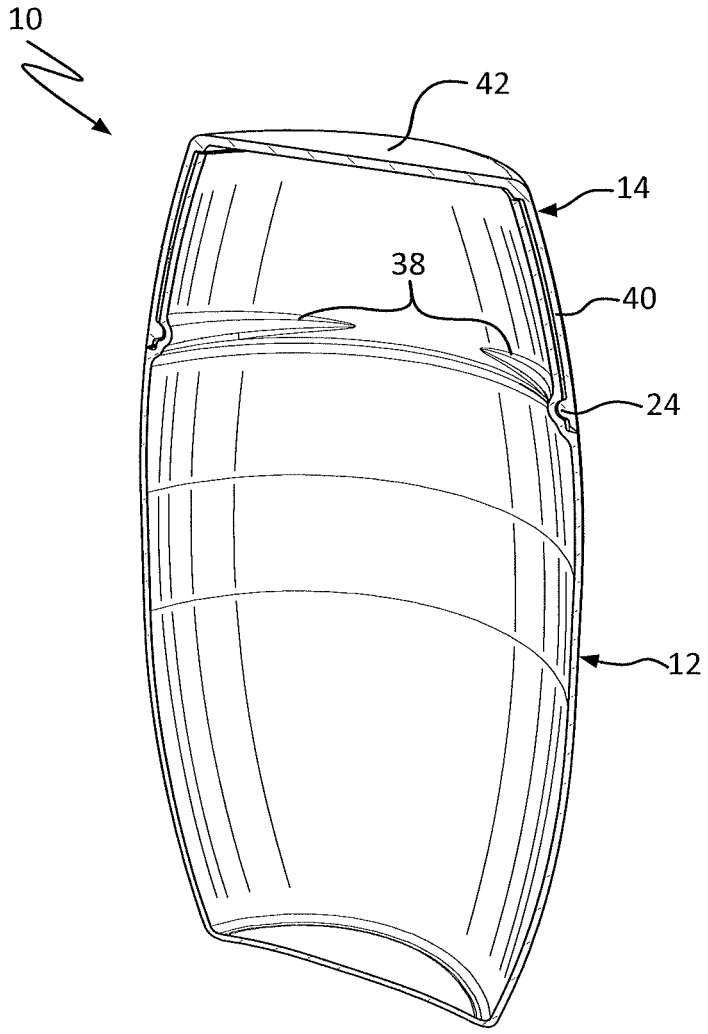
FIG. 11 is an isometric view of a cross section of the package, with the section taken similar to that shown in FIG. 8.

In FIG. 10, the container rim 32 is shown spaced from the top wall 42 of the lid 14. This spacing is optional. An engagement of the rim 32 with the lid top wall 42 may assist in sealing the interior volume 30 of the base 12. A stabilizing ridge 44 is shown in the corner of the sidewall 40 and top wall 42 of the lid 14. This ridge 44 is positioned adjacent the rim 32. A sealing engagement by the rim 32 with the ridge 44 may also be formed. Alternatively or in addition to the engagement between the rim 32 and the lid 14, a membrane (not shown) may be releaseably fixed to the base rim 32 for sealing the contents of the base container 12. The membrane is typically removed by the user during initial opening of the package 10, with the lid 14 preferably forming a freshness seal after the opening. An outer wrapper (not shown) may also be provided for sealing the package. For example, a shrink wrap label may surround the package, securing the base and lid and providing decorative graphics. Further, an extended ledge or shelf (not shown) may be provided on the rim 32 of the container 12 for supporting or suspending a dip cup or the like. The dip cup preferably holds a complimentary sauce for application to the contents of the container base during consumption.

Figure 13:
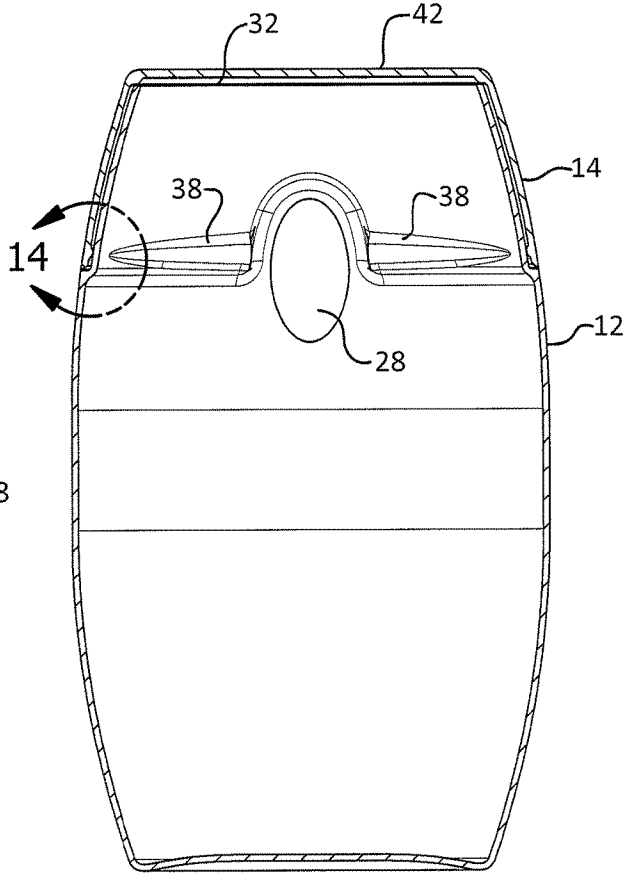
FIG. 13 is a further cross section view of the package, as taken along line 13-13 in FIG. 6.
Figure 14:
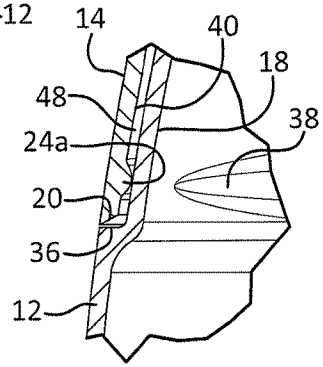
FIG. 14 is an enlarged detail view of part of the package, as taken from the cross section in FIG. 13.
Figure 12:
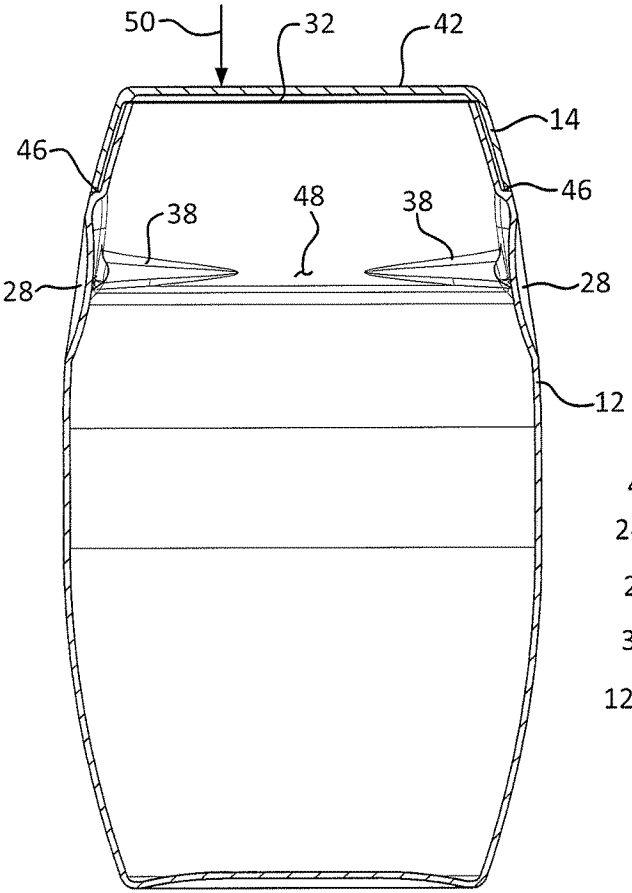
FIG. 12 is a further cross section view of the package, as taken along line 12-12 in FIG. 5.

The retaining grooves 38 are shown to be discontinuous around the perimeter of the top end 18 of the base 12. The grooves 38 are tapered away from the position of the buttons 28. The tapering of the grooves 38 assists in release of the lid 14 from the base 12. In FIGS. 12-14, there is shown the engagement of the retainer bar 24 on the lid 14, outside the channel formed by the retainer grooves 38. In FIG. 12, the buttons 28 are shown in cross section with the retainer grooves 38 positioned adjacent the buttons 28. The contours of the rim 20 of the lid 14 define a pair of slots 46 that surround the buttons 28 upon assembly. The opposite side retainer bars 24 discontinue in the area of the contour slots 46. A space 48 is provided between the receiving grooves 38 on the top end 18 of the base 14. This space 48 is formed without grooves or engagement ridges. As shown in more detail in FIG. 14, the retainer bar 24 contacts the wall of the top end 18 of the base 12 in the space 48 between the grooves 38. In addition, the thickness of the relatively central portion 24*a* of the retainer bar 24 is preferably less than the thickness of the bar portions received within the grooves 38. A comparison of FIGS. 9 and 14 further identifies this dimensional difference and the corresponding engagement between the lid 14 and the top end 18 of the base 12.

The engagement structures 16 on the top end 18 of the container base 12 provide means for engagement of the retainer bars 24 on the lid 14 to fix the lid 14 to the top end 18 of the base 14 and to form the assembled package 10. The retainer bar 24 engages within the grooves 38 in a friction fit. The central portion 24*a* of the retainer bar further engages the sidewall of the top end 18 of the base 14.

The retained lid 14 is released from the base 12 by application of the release force 26 (see arrows in FIG. 3). The release force 26 causes a flexing and deformation of the sidewall of the base 12, reducing the lateral dimension at the buttons 28 and increasing the lateral dimension at the location of the space 48, between the grooves 38. The increase in dimension causes the retainer bar 24 to move out of the grooves 38, preferably with a release "pop" being created.

Based on the contemplated dimensions and materials of the package 10, a typical user will be able to squeeze the base 12 with one hand, applying the release force 26 at the buttons 28. The release of the lid 14 will move into the user's hand, providing easy removal and then inversion of the lid 14. The contours 46 on the rim 20 of the lid 14 may assist in gripping the released lid. Once inverted, the portion control volume 22 of the interior of the lid 14 is accessible. A portion of the retained contents within the interior volume 30 of the base 12 may then be easily poured into the volume 22 of the lid 14.

Replacement of the lid 14 onto the top end 18 of the base 12 is easily accomplished by a downward force 50 (FIG. 12) on the top wall 42 of the lid 14, causing the engagement structures 16 to interact. The contour slots 46 provide for proper alignment of the lid 14 with the base 12. The slots 46 preferably surround and mate with the projecting buttons 28 on the top end 18 of the base 12.

As a non-limiting example, the base 12 of the package 10 may be dimensioned to retain a overall volume 30 of goods of about eight (8) ounces, with the lid volume 22 formed to receive about two (2) ounces. Hence, the package 10 retains about four (4) individual servings. The size of the lid 14 defines the serving portion and additional portions may be consumed only after pouring an additional amount into the portion volume 22 defined by the lid 14. The additional step of dispensing a new portion has been found to deter excess consumption.

In the drawings and specification, there has been set forth a number of embodiments of the invention and, although specific terms are employed, these terms are used in a generic and descriptive sense only and not for purposes of limitation. The scope of the invention is set forth in the following claims.

What is claimed is:

1. A package for storing and dispensing consumable goods, the package comprising:

a container base having a defined interior volume for retaining a quantity of consumable goods, and an open top end for dispensing the goods, a lid formed to overlap the top end of the base, the lid having a defined portion volume that is less than the interior volume of the base, retaining means for frictional engagement of the lid on the top end of the base, and activating means for releasing the frictional engagement between the lid and the top end of the base, wherein the retaining means is formed in part adjacent the top end of the base and in part within the portion volume of the lid, wherein the activating means comprises at least one activation button formed on the sidewall of the base, the activation button defining a receiving area for a lid release activation force causing a flexing of the top end of the base, wherein the retaining means comprises a plurality of retaining grooves and at least one retaining bar formed for receipt within and frictional engagement with the retaining grooves upon overlap of the lid on the top end of the base, and wherein the retaining grooves are formed in the sidewall of the top end of the base and wherein the at least one retaining bar is formed on an inside surface of the sidewall of the lid.

2. A package as in claim 1 wherein the lid comprises a rim, the lid rim contoured to surround the at least one activation button upon overlap of the lid on the top end of the base.

3. package as in claim 1 wherein the activating means comprises a second activation button formed on the sidewall of the base, the second activation button positioned opposite the at least one activation button on the sidewall of the base, wherein the release activation force on the buttons causes flexing of the sidewall of the base and disengagement of the retaining means on the base and lid.

4. package as in claim 3 wherein the lid comprises a rim, the lid rim being contoured to surround both activation buttons upon overlap of the lid on the top end of the base and frictional engagement of the retaining means.

5. A package for storing and dispensing consumable goods, the package comprising:

a container base having a defined interior volume for retaining a quantity of consumable goods, and an open top end for dispensing the goods, a lid formed to overlap the top end of the base, the lid having a defined portion volume that is less than the interior volume of the base, retaining means for frictional engagement of the lid on the top end of the base, and activating means for releasing the frictional engagement between the lid and the top end of the base, wherein the retaining means is formed in part adjacent the top end of the base and in part within the portion volume of the lid, wherein the activating means comprises at least one activation button formed on the sidewall of the base, the activation button defining a receiving area for a lid release activation force causing a flexing of the top end of the base, wherein the retaining means comprises a plurality of retaining grooves and at least one retaining bar formed for receipt within and frictional engagement with the retaining grooves upon overlap of the lid on the top end of the base, and wherein the retaining grooves are formed in the sidewall of the top end of the base, with one of the retaining grooves positioned on opposite sides of the at least activation button, wherein the at least one retaining bar is formed on an inside surface of the sidewall of the lid, and a portion of the at least one retaining bar is received within one of the retaining grooves.

6. A package for storing and dispensing consumable goods, the package comprising:

a container base having a defined interior volume for retaining a quantity of consumable goods, and an open top end for dispensing the goods, a lid having a bottom wall and a surrounding sidewall projecting from the bottom wall, the lid defining a portion volume that is less than the interior volume of the base, the sidewall of the lid formed to overlap a side wall of the base at the top end of the base, retaining means for frictional engagement of the lid sidewall with the sidewall of base at the top end, the retaining means formed in part adjacent the top end of the base and in part on the overlapping portion of the side wall of the lid, and at least one activation button formed on the sidewall of the base, the activation button defining a receiving area for a lid release activation force, wherein the release activation force causes a flexing of the sidewall of the base and disengagement of the retaining means on the base and lid, wherein the retaining means comprises a plurality of retaining grooves and at least one retaining bar, the retaining bar formed for receipt and frictional engagement within the retaining grooves upon overlap of the lid on the top end of the base, and wherein the retaining grooves are formed in the sidewall of the top end of the base and wherein the at least one retaining bar is formed on an inside surface of the sidewall of the lid.

7. A package as in claim 6 wherein the lid comprises a rim, the lid rim being contoured to surround the at least one activation button upon overlap of the lid on the top end of the base and frictional engagement of the retaining means.

8. A package as in claim 6 wherein one retaining groove is positioned on opposite sides of the at least activation button, and wherein retaining bars are formed on the lid for engagement within each of the retaining grooves.

9. A package as in claim 6 further comprising a second activation button formed on the sidewall of the base, the second activation button positioned opposite the at least one activation button on the sidewall of the base, both activation buttons defining a receiving area for a lid release activation force, wherein the release activation force on the buttons causes flexing of the sidewall of the base and disengagement of the retaining means on the base and lid.

10. A package as in claim 9 wherein the lid comprises a rim, the lid rim being contoured to surround both activation buttons upon overlap of the lid on the top end of the base and frictional engagement of the retaining means.

* * * * *